US006054037A

United States Patent [19]

Martin

[11] Patent Number: 6,054,037

[45] Date of Patent: Apr. 25, 2000

[54] HALOGEN ADDITIVES FOR ALKALINE COPPER USE FOR PLATING ZINC DIE CASTINGS

[75] Inventor: Sylvia Martin, Shelby Township, Mich.

[73] Assignee: Enthone-OMI, Inc., Warren, Mich.

[21] Appl. No.: 09/189,875

[22] Filed: Nov. 11, 1998

[51] Int. Cl.[7] ..... C25D 3/38

[52] U.S. Cl. ..... 205/295; 205/296; 205/239; 106/1.26

[58] Field of Search ..... 205/295, 296, 205/239; 106/1.26

[56] References Cited

U.S. PATENT DOCUMENTS

| | | | |
|---|---|---|---|
| 3,928,147 | 12/1975 | Kowalski | 204/52 R |
| 4,462,874 | 7/1984 | Tomaszewski et al. | 204/52 R |
| 4,469,569 | 9/1984 | Tomaszewski et al. | 204/52 R |
| 4,521,282 | 6/1985 | Tremmel | 204/52 R |
| 4,933,051 | 6/1990 | Kline | 204/52.1 |
| 5,421,985 | 6/1995 | Clouser et al. | 205/77 |
| 5,607,570 | 3/1997 | Rohbani | 205/297 |
| 5,750,018 | 5/1998 | Brasch | 205/295 |

OTHER PUBLICATIONS

*Interzinc, Zinc Casting, A Systems Approach*, Eastern Alloys, Inc., pp. 6–7. "Comparison of Typical Casting Alloy Properties" (table). No date available.

*Primary Examiner*—Kishor Mayekar

*Attorney, Agent, or Firm*—Harness, Dickey & Pierce, P.L.C.

[57] ABSTRACT

A method and electrolyte bath for depositing $Cu^{+1}$ ions from the cathode diffusion layer onto a zinc substrate. Halogen ions are used as additives to organophosphonate alkaline copper electrolytes for stabilizing $Cu^{+1}$ in the cathode diffusion layer.

14 Claims, 1 Drawing Sheet

HALOGEN ADDITIVES FOR ALKALINE COPPER USE FOR PLATING ZINC DIE CASTINGS

BACKGROUND OF THE INVENTION

The present invention relates to the plating of copper onto zinc substrates or the like. More particularly, the present invention relates to a method for plating of $Cu^{+1}$ (copper I or cuprous) ions out of a $Cu^{+2}$ (copper II or cupric) bath from the cathode diffusion layer.

Zinc die castings are common in consumer and automotive applications. Many times it is desirable to plate chromium plate over zinc die castings or the like. Particularly in such situations, it is necessary to provide a strike of copper and/or nickel as an undercoat to a chromium plating operation. The quality of the resulting chromium plate is directly proportional to the adherency of the underlying copper strike.

It has long been known that use of copper cyanide electrolytes provides good plating results with adherent copper deposits on a zinc substrate. Because of the existence of cyanide in these solutions, several environmental disadvantages have been found. For instance, if the pH becomes too low in the bath, hydrogen cyanide gas may be produced, causing a hazard to workers or the like. Additionally, the by-products of such baths are highly toxic, creating hazardous waste disposal problems. Thus, there has been a long sought need in the art to replace cyanide copper plating with cyanide-free processes while maintaining the desirable characteristics of copper plate on zinc substrates.

Many cupric based processes which attempt to remove the cyanide electrolyte and replace it with less toxic copper strikes have been proposed. Typically, these are organophosphonate-type baths and provide limited results, provided the chemistry is watched very closely. Examples of these include: U.S. Pat. No. 4,521,282, entitled "Cyanide-Free Copper Electrolyte and Process"; U.S. Pat. No. 4,469,569, entitled "Cyanide-Free Copper Plating Process"; and U.S. Pat. No. 4,462,874, entitled "Cyanide-Free Copper Plating Process", all of which are commonly assigned to the present assignee. While these processes have proven commercially effective, there still remains a need to provide more adherent copper strikes on zinc substrates in a cyanide-free process. One process which has been proposed to duplicate the $Cu^{+1}$ plating of cyanide solutions is that set forth in U.S. Pat. No. 5,750,018, entitled "Cyanide-Free Monovalent Copper Electroplating Solutions". This patent discloses a cuprous copper bath by utilizing strong reducing agents and low pH phosphate or pyrophosphate based copper electrolytes. By utilizing these strong reducing agents, a $Cu^{+1}$ ion is plated onto the zinc, creating a strong copper strike. While such baths may prove useful in creating a copper plate having cyanide bath-type properties, such baths are inherently unstable due to the nature of the copper ion.

Copper ions have an affinity to a $Cu^{+2}$ valence. Thus, in order to maintain the $Cu^{+1}$ valence found in the '018 patent, the bath chemistry must be carefully monitored and adjusted to maintain these parameters. Additives quickly break down in such low pH conditions, further complicating maintenance of the baths. Therefore, from a commercial plating viewpoint, this process is undesirable because it requires very high maintenance and close monitoring to maintain a relatively unstable $Cu^{+1}$ bath.

Therefore, there remains a need in the art to provide a suitable cyanide-free copper process for plating over zinc die cast. Preferably, the copper strike plated from such a process has the physical adherency properties which are close to or equivalent to cyanide copper-type strikes.

SUMMARY OF THE INVENTION

Thus, in accordance with the present invention, there is provided a process for electroplating of adherent copper onto zinc substrate from a cupric electroplating bath. The present process includes the steps of providing a phosphonate based cupric electrolyte bath, which includes an effective concentration of halogen ions for allowing the electroplating of cuprous copper to form in the cathode diffusion layer and to electrodeposit copper onto the zinc substrate from the generally cupric ion electrolyte. A zinc cathode workpiece is provided along with an anode in the electrolyte for electroplating from the bath. Thereafter, electroplating current to the anode and the cathode is provided for electroplating of the adherent copper plate onto the zinc cathode. The copper strikes provided by such a process are highly adherent to the zinc material, indicating that the copper was deposited from a $Cu^{+1}$ ion. Thus, copper cyanide-type plates are provided with cuprous ions being plated onto the zinc substrate from a cupric bath.

Further understanding of the present invention will be had by reference to the Figure and Detailed Description of the Preferred Embodiments set forth below and the examples appended hereto, in view of the claims.

DETAILED DESCRIPTION OF THE PREFERRED EMBODIMENTS

Figure 1:
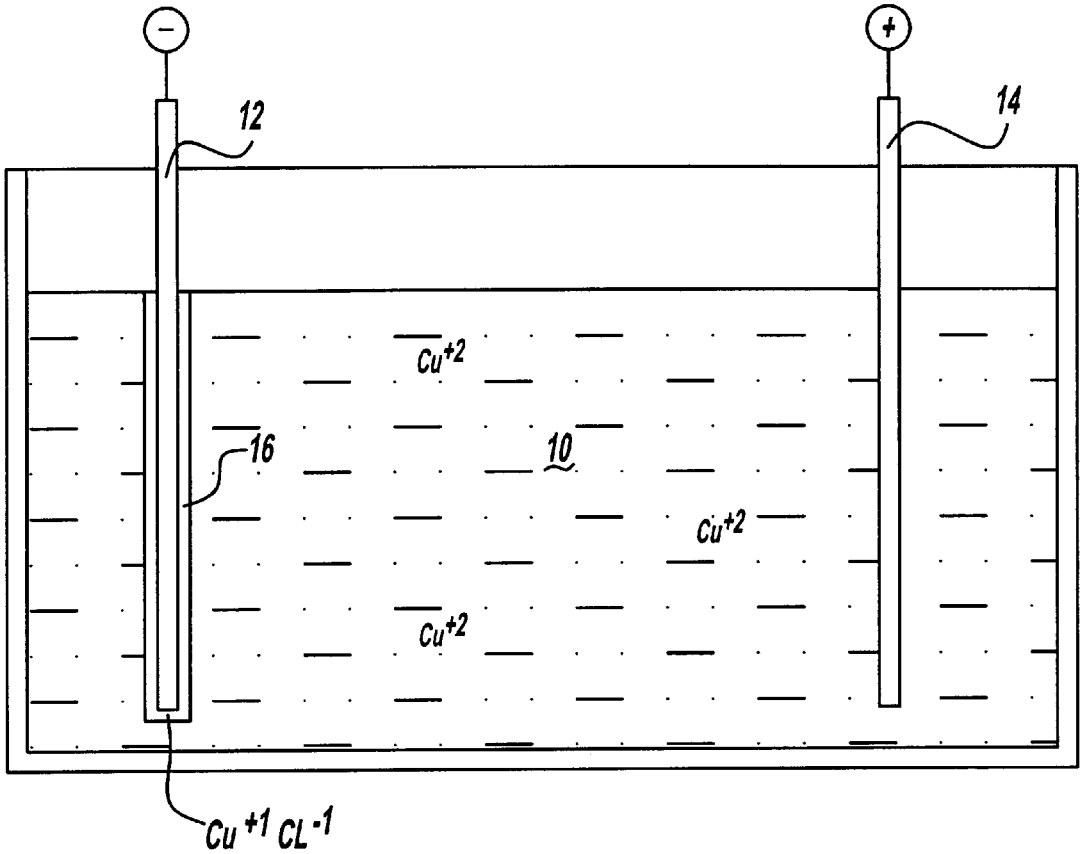
FIG. 1 is a schematic illustrating an electroplating bath operating in accordance with the teachings of the present invention.

In accordance with the present invention, there is provided a process for electroplating of an adherent copper (cuprous) ion onto a zinc substrate from a cupric electroplating bath 10. In its broad aspects, the invention includes the steps of providing a phosphonate cupric electrolyte bath 10 in which there is an effective concentration of halogen ions. The halogen ions allow for electroplating of cuprous copper onto a zinc substrate from the cathodic diffusion layer of a cupric electrolyte. In order to complete the bath 10, there is required a zinc cathode workpiece 12 for plating upon and an anode 14 which is positioned in the bath 10 for electroplating from the bath 10. An electroplating current is thereafter applied between the anode 14 and the zinc cathode 12 workpiece for electroplating the adherent copper plate onto a zinc cathode 12 substrate.

The general bath make-up used in the present invention is an organophosphonate base, cyanide-free copper electrolyte. A suitable copper electrolyte in the present invention is set forth in U.S. Pat. No. 4,469,569, entitled "Cyanide-Free Copper Plating Process", issued to Tomaszewski, et al. on Sep. 4, 1984, which is hereby incorporated herein by reference.

While details of baths which are useful in the present invention are set forth in the above patent, generally the bath 10 includes effective amounts of cupric ions, an organophosphonate chelating agent, a bath soluble carbonate, hydroxyl ions to provide an alkaline pH, and preferably a wetting agent. In addition, as set forth above, the bath 10 useful for plating cuprous ions out of the electrolyte includes an effective quantity of a halogen, which is normally thought to be detrimental to these cyanide-free aqueous alkaline solutions. The copper ions may be introduced into the bath 10 by way of a bath soluble compatible copper salt. Typically, copper salts used in the present invention include copper from copper acetate, copper from copper sulfate, copper from copper chlorides, or copper from a copper salt of an organophosphonate.

Typically, copper is provided in the solution in amounts of from about 3 up to about 50 grams per liter (g/l), and preferably about 5 to about 20 g/l. A bath critical component is the organophosphonate complexing agent which is useful and essential in baths of the present invention. Such agents include one hydroxyethylidene-1,1di-phosphonic acid (HEDP), aminotrimethylene phosphonic acid (ATMP), ethylene diamine tetra methylene phosphonic acid (EDTMP), or mixtures thereof. Typically, these additives are present in amounts of 50 to about 500 g/l.

As set forth above, carbonate stabilizing agents are provided which are typically employed by use of bicarbonates of soluble alkali metals and alkaline earth metals such as potassium bi-carbonates. Hydroxyl ions are used to control the pH of from about 7.5 to about 10.5, with preferably pHs being from about 9.5 to 10. These baths are typically run at temperatures of between 100° F. to about 160° F. Preferably, the baths are maintained in a range from about 110° F. to about 140° F. Generally, bath plating conditions are from about 1 to about 50 amps per square foot (ASF), with a current density of about 5 to about 25 ASF being typical, and 10 to 15 ASF being preferred.

The agent which stabilizes the cuprous ion in the cathode diffusion layer, making $Cu^{+1}$ available for plating, is an effective quantity of halogen ions in the bath 10. Typically, halogen ions such as chlorides, bromides, fluorides and the like have been thought to be contaminants in organophosphonate cupric baths. In the present invention it was found that use of halogen ions, which are preferably chlorides, fluorides, bromides or mixtures thereof, produce the desired effect of plating of cuprous ions out of the bath's cathodic diffusion layer. Typically, these agents are used in levels of from about 3.5 g/l to about 40 g/l of halogen ions. Typically, from about 7 to about 20 g/l are employed, with preferred ranges being about 7 to 10 g/l. Concentrations below 3.5 g/l tend to revert the critical $Cu^{+1}$ ionic species to all $Cu^{+2}$ types, such that the desirable adhesion of the present invention is undermined. Typically, if chloride ions are used, lower levels in the above range are used, whereas if bromides or fluorides are used, higher levels must be used.

Halogens are useful in the present invention and include chlorides, bromides and fluorides, with a preferred halogen being a chloride ion. Typically, these can be introduced into the bath 10 by way of a potassium salt. While sodium salts of these elements are also readily available, it is believed that the bath 10 cannot tolerate sodium as it would lower the copper solubility resulting in ineffective levels of copper in solution. Thus, while sodium salt may be used, over long periods of time the bath 10 may become ineffective because of the copper solubility limitations imposed by use of sodium ions. Therefore, potassium cation salts are preferred for use in the present invention.

In operation, the electrolyte bath 10 of the present invention may be readily used to plate zinc die cast or zincated aluminum. The present invention gives adherent copper deposits with in-situ diffusion layer production of $Cu^{+1}$ ions while readily using the much more stable $Cu^{+2}$ bath. Thus, plating over hot chamber pressure zinc die cast alloys may be accomplished by use of the subject invention. For instance, the subject invention has been found to be effective over zinc casting alloys such as ZAMAK 2, 3, 5 and 7 alloys (defined in Table 1 below), which have not readily accepted copper plating in the past. The advantage of the present invention is that after a copper strike has been plated over the zinc alloys with good adhesion, this provides superior adhesion to further plating of chromium or nickel or the like.

Without wishing to be bound by theory, it is believed that a temporarily stabilized $Cu^{+1}Cl^{-1}$ ion complex is formed in the cathode film 16 around the zinc cathode 12 to be plated. This, it is believed, allows for adherent deposit plating.

Further understanding of the present invention will be had with reference to the enclosed examples, which are set forth herein for purposes of exemplary embodiments but not limitation of the present invention. For purpose of the examples, reference to the following zinc die cast elemental table is made.

TABLE 1

| Nominal Composition of Zinc Casting Alloys (wt. %) Alloy (ASTM) Designation | | | | |
|---|---|---|---|---|
| Element | No. 2 (—) | No. 3 (Z33521) | No. 5 (Z35530) | No. 7 (Z33522) |
| Aluminum | 4 | 4 | 4 | 4 |
| Magnesium | 0.035 | 0.035 | 0.055 | 0.013 |
| Copper | 8 | — | 1 | — |
| Nickel | — | — | — | 0.013 |
| Zinc | Remainder | Remainder | Remainder | Remainder |

EXAMPLE 1

A bath is prepared using 5 g/l copper from copper acetate, 75 g/l potassium salt of hydroxyethylidene di-phosphonic acid, 15 g/l potassium chloride and 23 g/l potassium carbonate. A solution pH of 9.5 to 10 is maintained and the plating is accomplished with air agitation at a temperature of about 140° F. with a current of 10 ASF.

The above bath is used to coat ZAMAK 3 and ZAMAK 5 zinc die casts. The above copper strikes are found to be sufficiently adherent for further application of noncyanide copper coatings for thickening of the deposit with better distribution. Thereafter, these coatings are found to be sufficient for further plating of chromium or nickel electroplating thereover.

EXAMPLE 2

A bath is prepared using 5 g/l copper from copper acetate, 75 g/l potassium salt of hydroxyethylidene di-phosphonic acid, 15 g/l potassium chloride and 23 g/l potassium carbonate. A solution pH of 9.5 is maintained and the plating is accomplished with air agitation at a temperature of about 135° F. with a current of 15 ASF.

The above bath is used to coat ZAMAK 3 and ZAMAK 5 zinc die casts. The above copper strikes are found to be sufficiently adherent for further application of noncyanide copper coatings for thickening of the deposit with better distribution. Thereafter, these coatings are found to be sufficient for further plating of chromium or nickel electroplating thereover.

EXAMPLE 3

A bath is prepared using 10 g/l copper from copper sulfate, 100 g/l potassium salt of hydroxyethylidene di-phosphonic acid, 20 g/l potassium chloride and 46 g/l potassium carbonate. A solution pH of 9.8 is maintained and the plating is accomplished with air agitation at a temperature of about 130° F. with a current of 18 ASF.

The above bath is used to coat ZAMAK 3 and ZAMAK 5 zinc die casts. The above copper strikes are found to be sufficiently adherent for further application of noncyanide copper coatings for thickening of the deposit with better distribution. Thereafter, these coatings are found to be sufficient for further plating of chromium or nickel electroplating thereover.

EXAMPLE 4

A bath is prepared using 3 g/l copper from copper chloride, 85 g/l potassium salt of hydroxyethylidene di-phosphonic acid, 10 g/l potassium chloride and 26 g/l potassium carbonate. A solution pH of 9.6 is maintained and the plating is accomplished with air agitation at a temperature of about 130° F. with a current of 5 ASF.

The above bath is used to coat ZAMAK 3 and ZAMAK 5 zinc die casts. The above copper strikes are found to be sufficiently adherent for further application of noncyanide copper coatings for thickening of the deposit with better distribution. Thereafter, these coatings are found to be sufficient for further plating of chromium or nickel electroplating thereover.

EXAMPLE 5

A bath is prepared using 5 g/l copper from copper salt of hydroxyethylidene di-phosphonic acid, 50 g/l potassium salt of hydroxyethylidene di-phosphonic acid, and 20 g/l potassium fluoride. A solution pH of 9.4 is maintained and the plating is accomplished with air agitation at a temperature of about 125° F. with a current of 10 ASF.

The above bath is used to coat ZAMAK 3 and ZAMAK 5 zinc die casts. The above copper strikes are found to be sufficiently adherent for further application of noncyanide copper coatings for thickening of the deposit with better distribution. Thereafter, these coatings are found to be sufficient for further plating of chromium or nickel electroplating thereover.

EXAMPLE 6

Separate organophosphonate cupric baths are prepared in accordance with U.S. Pat. No. 4,469,569, using levels of each chloride, bromide and fluoride ions in concentration of 3, 5, 7, 10, 20 and 40 g/l. ZAMAK 2, 3, 5 and 7 alloys are plated using air agitation, 10 ASF and 125° F. bath temperatures. The resulting copper strikes are found to be adherent and suitable for adherent plating of further cupric copper thereover and chromium plating thereafter.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and following claims.

What is claimed is:

1. A process for electroplating of adherent copper onto a zinc substrate from a cupric electroplating bath, consisting essentially of:

(a) providing a phosphonate based cupric electrolyte bath, including an effective concentration of halogen ions for allowing electroplating of cuprous copper onto a zinc substrate from the substantially cupric electrolyte bath;

(b) providing a zinc cathode workpiece and an anode for electroplating from said bath; and (c) providing an electroplating current between said anode and said zinc cathode workpiece for electroplating an adherent copper plate onto said zinc cathode.

2. The process of claim 1 wherein said phosphonate based cupric electrolyte also includes copper acetate as a source of cupric ions in the bath.

3. The process of claim 1 wherein the said halogen ions are selected from the group consisting of chloride, bromide, ions and mixtures thereof fluoride.

4. The process of claim 1 wherein said halogen ions are chloride ions.

5. The process of claim 1 wherein said halogen ions are provided in said bath in amounts of from about 3.5 g/l to about 40 g/l.

6. The process of claim 1 wherein said halogen ions are provided in said bath in amounts of from about 7 g/l to about 20 g/l.

7. The process of claim 1 wherein said halogen ions are provided in said bath in amounts of from about 7 g/l to about 10 g/l.

8. An electroplating bath which is effective for plating of adherent $Cu^{+1}$ onto a zinc substrate from the cathode diffusion layer comprising:

an alkaline copper electrolyte including an organophosphonate additive; and an effective amount of a halogen ion component which provides for stabilization of $Cu^{+1}$ ions at the cathode diffusion film and plating of adherent copper onto said zinc substrate.

9. The bath of claim 8 wherein said electrolyte comprises from about 3.5 to about 40 g/l of said halogen ion component.

10. The bath of claim 8 wherein said halogen ion is selected from the group consisting of chloride, bromide, fluoride ions and mixtures thereof.

11. The bath of claim 8 wherein said electrolyte comprises from about 7 to about 20 g/l of said halogen ion component.

12. The bath of claim 11 wherein said halogen ion is selected from the group consisting of chloride, bromide, fluoride ions and mixtures thereof.

13. The bath of claim 8 wherein said electrolyte comprises from about 7 to about 10 g/l of said halogen ion component.

14. The bath of claim 13 wherein said halogen ion is selected from the group consisting of chloride, bromide, fluoride ions and mixtures thereof.

* * * * *

UNITED STATES PATENT AND TRADEMARK OFFICE

CERTIFICATE OF CORRECTION

PATENT NO. : 6,054,037

DATED : April 25, 2000

INVENTOR(S) : Sylvia Martin

It is certified that error appears in the above-identified patent and that said Letters Patent is hereby corrected as shown below:

Under "OTHER PUBLICATIONS", Line 2 should be --Alloys, Inc., pp. 6-7.-- and Line 3 should be --"Comparison of Typical Casting Alloy Properties" (table).-- and Line 4 should be --No date available.--.

Column 6, Line 19, after "bromide," insert --fluoride--.

Column 6, Line 20, "thereof fluoride." should be --thereof.--

Signed and Sealed this

Twenty-second Day of May, 2001

*Attest:*

Nicholas P. Godici

NICHOLAS P. GODICI

*Attesting Officer*

*Acting Director of the United States Patent and Trademark Office*